US007899352B2

(12) United States Patent
Tomiie et al.

(10) Patent No.: US 7,899,352 B2
(45) Date of Patent: Mar. 1, 2011

(54) IMAGE FORMING APPARATUS

(75) Inventors: Norio Tomiie, Osaka (JP); Shinki Miyaji, Osaka (JP); Yoshihiko Maruyama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 590 days.

(21) Appl. No.: 12/072,748

(22) Filed: Feb. 28, 2008

(65) Prior Publication Data

US 2008/0304853 A1 Dec. 11, 2008

(30) Foreign Application Priority Data

Mar. 6, 2007 (JP) ..... 2007-055484
Mar. 6, 2007 (JP) ..... 2007-055485

(51) Int. Cl.
*G03G 15/00* (2006.01)
*G03G 15/02* (2006.01)

(52) U.S. Cl. ..... 399/89; 399/50; 399/174

(58) Field of Classification Search ..... 399/50, 399/88, 89, 174, 175
See application file for complete search history.

(56) References Cited

U.S. PATENT DOCUMENTS

| | | | | |
|---|---|---|---|---|
| 4,851,960 | A | 7/1989 | Nakamura et al. | |
| 6,532,347 | B2 | 3/2003 | Watanabe et al. | |
| 2002/0041767 | A1 * | 4/2002 | Saito et al. | 399/44 |
| 2007/0098424 | A1 * | 5/2007 | Okada | 399/50 |
| 2007/0189788 | A1 * | 8/2007 | Hagiwara et al. | 399/44 |

FOREIGN PATENT DOCUMENTS

| | | |
|---|---|---|
| JP | 63-149668 | 6/1988 |
| JP | 2001-201920 | 7/2001 |
| JP | 2001-201921 | 7/2001 |
| JP | 2001-242723 | 9/2001 |
| JP | 2004-205583 | 7/2004 |
| JP | 2005-300745 | 10/2005 |
| JP | 2006-171282 | 6/2006 |
| JP | 2006-301437 | 11/2006 |

* cited by examiner

*Primary Examiner*—David M Gray
*Assistant Examiner*—Joseph S Wong
(74) *Attorney, Agent, or Firm*—Jordan and Hamburg LLP

(57) ABSTRACT

An aspect of the invention provides a charging control device of a color image forming apparatus, and the charging control device can properly control a charging potential of an image bearing body such that fog and uneven density are not generated even in a low-temperature environment. The image forming apparatus includes a high-voltage generation circuit 91 which applies an oscillating voltage to the charging member 42 disposed in contact with an image bearing body 41, a direct-current voltage and an alternating-current voltage being superimposed to form the oscillating voltage; a current detection unit 92 which detects a direct current value passed from the charging member 42 to the image bearing body 41; and a voltage control unit 96 which controls the alternating-current voltage such that the detected direct-current value is maintained in a target current range. The image forming apparatus also includes an aging control unit 95 to perform running-in. The aging control unit 95 rotates and drives the image bearing body 41 while retaining the alternating-current voltage and the direct-current voltage at previously-set predetermined voltages.

12 Claims, 17 Drawing Sheets

| TEMPERATURE | AGING TIME T (s) |
|---|---|
| NOT LOWER THAN 15° C | 0 |
| NOT LOWER THAN 13° C TO LOWER THAN 15° C | 60 |
| NOT LOWER THAN 10° C TO LOWER THAN 13° C | 120 |
| NOT LOWER THAN 7° C TO LOWER THAN 10° C | 200 |
| NOT LOWER THAN 5° C TO LOWER THAN 7° C | 300 |
| NOT LOWER THAN 3° C TO LOWER THAN 5° C | 500 |
| LOWER THAN 3° C | 800 |

Fig.7

| TEMPERATURE | NUMBER OF ITERATIONS N (TIME) |
|---|---|
| NOT LOWER THAN 15° C | 0 |
| NOT LOWER THAN 13° C TO LOWER THAN 15° C | 2 |
| NOT LOWER THAN 10° C TO LOWER THAN 13° C | 4 |
| NOT LOWER THAN 7° C TO LOWER THAN 10° C | 6 |
| NOT LOWER THAN 5° C TO LOWER THAN 7° C | 10 |
| NOT LOWER THAN 3° C TO LOWER THAN 5° C | 15 |
| LOWER THAN 3° C | 30 |

Fig.15

IMAGE FORMING APPARATUS

This application is based on applications No. 2007-055484 and No. 2007-055485 filed in Japan, the contents of which are hereby incorporated by reference.

BACKGROUND OF THE INVENTION

1. Field of the Invention

The present invention relates to an image forming apparatus into which a charging control device is incorporated. The charging control device includes a high-voltage generation circuit which applies an oscillating voltage to a charging member which is disposed while brought into contact with or close to an image bearing body, a direct-current voltage and an alternating-current voltage being superimposed to form the oscillating voltage; and a voltage control unit which controls a peak-to-peak voltage value Vpp of the alternating-current voltage to a target voltage.

2. Description of the Related Art

Recently, a charging control device in which a contact charging method is adopted is becoming the mainstream from the viewpoints of low-voltage process of lowering a charging control voltage applied to an image bearing body, reduction of ozone generated in charging control, and cost reduction. In the contact charging method, a roller type or a blade type charging member is disposed while brought into contact or close to a surface of the image bearing body, and an oscillating voltage in which a direct-current voltage and a alternating-current voltage are superimposed is applied to the charging member to evenly charge the surface of the image bearing body. At this point, the oscillating voltage is not limited to a sine wave, but any periodically-changing oscillation waveform such as a rectangular wave, triangular wave, and a pulsating wave can be used.

Japanese Laid-Open Patent Publication No. 63-149668 discloses a technique in which the following charging characteristics are exerted when the above-described contact charging method is adopted.

That is, when a peak-to-peak voltage value of the alternating-current voltage in the oscillating voltage is boosted, a charging voltage of the image bearing body is increased in proportion to the increase in peak-to-peak voltage value. A charging potential is saturated when the peak-to-peak voltage value reaches about double a charging start voltage of the direct-current voltage, and the charging potential is not changed even if the peak-to-peak voltage value is further boosted. In order to ensure evenness of the charging, it is necessary to apply the oscillating voltage having the peak-to-peak voltage not lower than double the charging start voltage in applying the direct-current voltage determined by various characteristics of the image bearing body. The charging voltage obtained at that time depends on a direct-current component of the applied voltage.

Japanese Laid-Open Patent Publication No. 2001-201921 discloses a charging control method, wherein the image bearing body is evenly charged by adjusting a discharge amount from the charging member to the image bearing body such that problems such as deterioration of the image bearing body, toner adhesiveness, and image deletion due to the discharge are not generated even if a resistance value of the charging member fluctuates due to an influence of an environment.

Specifically, the control is performed as follows. During a non-image formation period, an alternating current value passed from the charging member to the image bearing body is detected, when at least one alternating-current voltage whose peak-to-peak voltage is lower than double a direct-current threshold voltage Vth is applied to the charging member. The direct-current threshold voltage Vth is one at which the discharge is started from the charging member to the image bearing body when the direct-current voltage is applied to the charging member.

Then, alternating current value passed from the charging member to the image bearing body are detected, when at least two alternating-current voltages whose peak-to-peak voltages are not lower than double the threshold voltage Vth are applied to the charging member.

The peak-to-peak voltage of the alternating-current voltage which should be applied in forming the image is determined based on the plural alternating current values detected in each step, and whereby the alternating-current voltage is controlled such that the peak-to-peak voltage is maintained in forming the image.

More specifically, a peak-to-peak voltage-alternating current function F1 and a peak-to-peak voltage-alternating current function F2 are determined on a two-dimensional coordinate in which a horizontal axis is set to a peak-to-peak voltage while a vertical axis is set to an alternating current. The peak-to-peak voltage-alternating current function F1 expresses a line segment connecting an origin (0 point) and an alternating current value which is detected when the peak-to-peak voltage lower than double the threshold voltage Vth is applied to the charging member. The peak-to-peak voltage-alternating current function F2 expresses a line segment including at least two alternating current values which are detected when the peak-to-peak voltage not lower than double the threshold voltage Vth is applied to the charging member. A peak-to-peak voltage value which becomes an intersecting point of the line segments expressed by the functions F1 and F2 is determined as the peak-to-peak voltage of the alternating-current voltage which should be applied in forming the image.

However, in an epichlorohydrin-rubber charging roller used as the charging member, characteristics fluctuate largely depending on an environment such as temperature and humidity. The adoption of the conventional charging control method in the epichlorohydrin-rubber charging roller causes the following problems. At this point, the image bearing body having the diameter of 30 mm is formed by depositing an amorphous silicon photoconductive layer having a thickness of 20 μm. The charging roller is disposed in contact with the image bearing body with a pressing force of 1 Kgf.

That is, as shown in FIG. 2, in a low-temperature environment (low-temperature environment 1 of FIG. 2), an electric resistance value of the epichlorohydrin rubber is increased to slow down motion of conductive ions in the rubber, which decreases the charging potential.

Accordingly, in order to adjust the charging potential of the image bearing body to a stable target potential, it is necessary that the peak-to-peak voltage value Vpp 1 of the alternating-current voltage be maintained at a peak-to-peak voltage value Vpp2 larger than a peak-to-peak voltage value Vpp 1 of ambient temperature environment.

However, in an extremely-low-temperature environment (low-temperature environment 2 of FIG. 2) such as 0° C., the peak-to-peak voltage value cannot be adjusted to a predetermined target potential even if the peak-to-peak voltage value is increased. In such low-temperature environments, because the charging potential at the image bearing body does not reach the target potential, problems such as fog (phenomenon in which toner adheres slightly to a background except for the image) and uneven density (phenomenon in which unevenness of charging state is generated to cause a fluctuation in density) are generated in the image formed in the image bearing body.

The problems are generated in not only a monochrome image forming apparatus in which the black toner is used, but also a tandem-type full-color image forming apparatus in which image bearing bodies are arranged in series along a sheet conveyance belt or an indirect transfer belt according to the yellow (Y), magenta M), cyan (C), and black (K) colors.

SUMMARY OF THE INVENTION

In view of the foregoing, an object of the invention is to provide an image forming apparatus which can properly control the charging potential of the image bearing body such that the fog and uneven density are not generated even in the low-temperature environment.

In accordance with an aspect of the invention, an image forming apparatus having a charging member which is disposed while brought into contact with or close to an image bearing body, the image forming apparatus includes a high-voltage generation circuit which applies an oscillating voltage to the charging member, a direct-current voltage and an alternating-current voltage being superimposed to form the oscillating voltage; a current detection unit which detects a direct current passed from the charging member to the image bearing body; a voltage control unit which controls a peak-to-peak voltage value of the alternating-current voltage applied from the high-voltage generation circuit to the charging member such that the direct current detected by the current detection unit falls within a target current range; and an aging control unit which rotates and drives the image bearing body while retaining the alternating-current voltage and the direct-current voltage at previously-set predetermined voltages.

Other aspects of the present invention will become apparent with reference to the following embodiments.

BRIEF DESCRIPTION OF THE DRAWINGS

FIG. 7 is an explanatory view of a temperature table;

FIG. 15 is an explanatory view showing a temperature table;

DESCRIPTION OF THE PREFERRED EMBODIMENT

A monochrome digital copying machine will be described below. The monochrome digital copying machine is an example of an image forming apparatus according to an embodiment of the invention into which a charging control device is incorporated.

Figure 4:
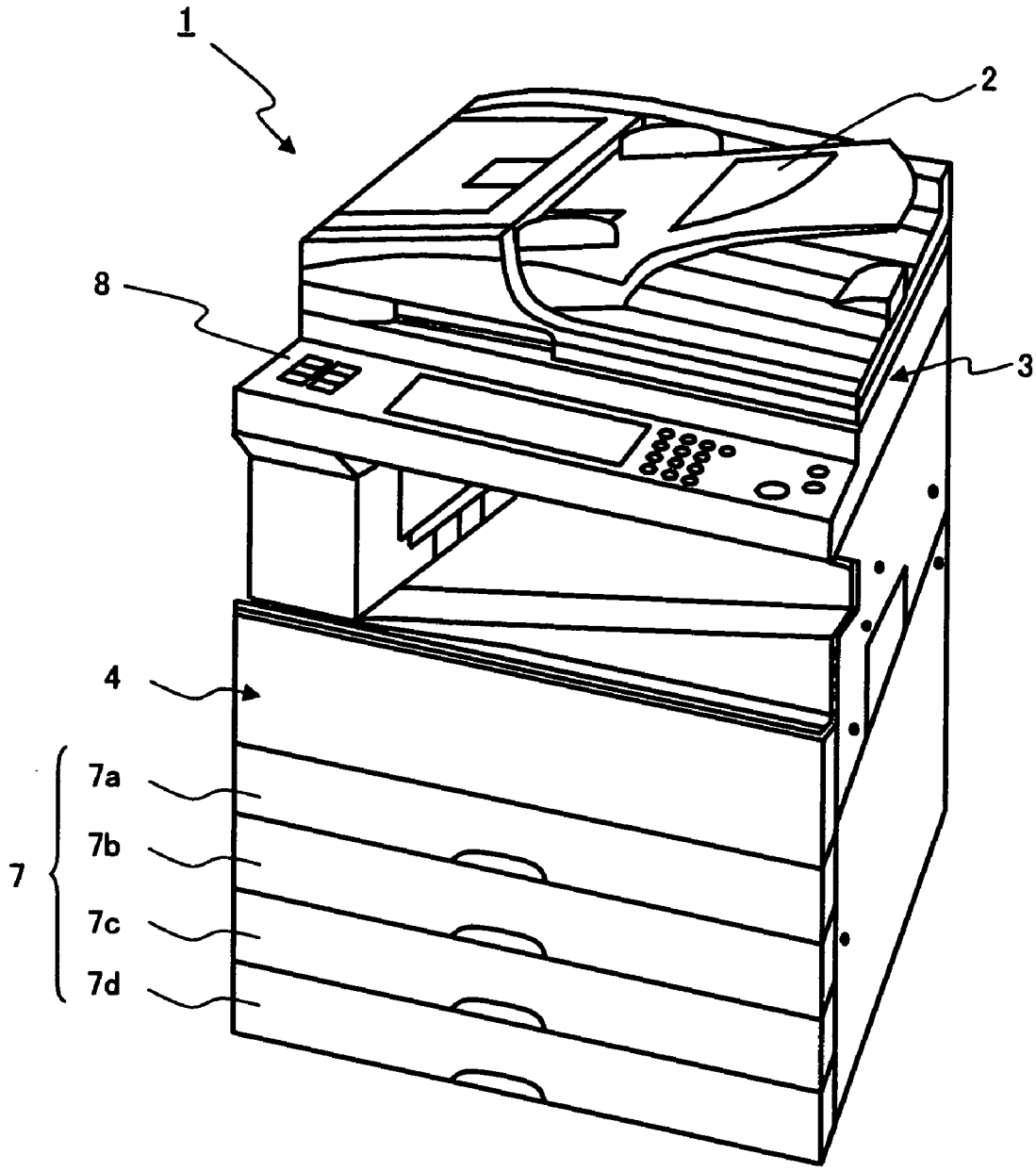
FIG. 4 shows an appearance of a digital copying machine according to an embodiment of the invention.
Figure 5:
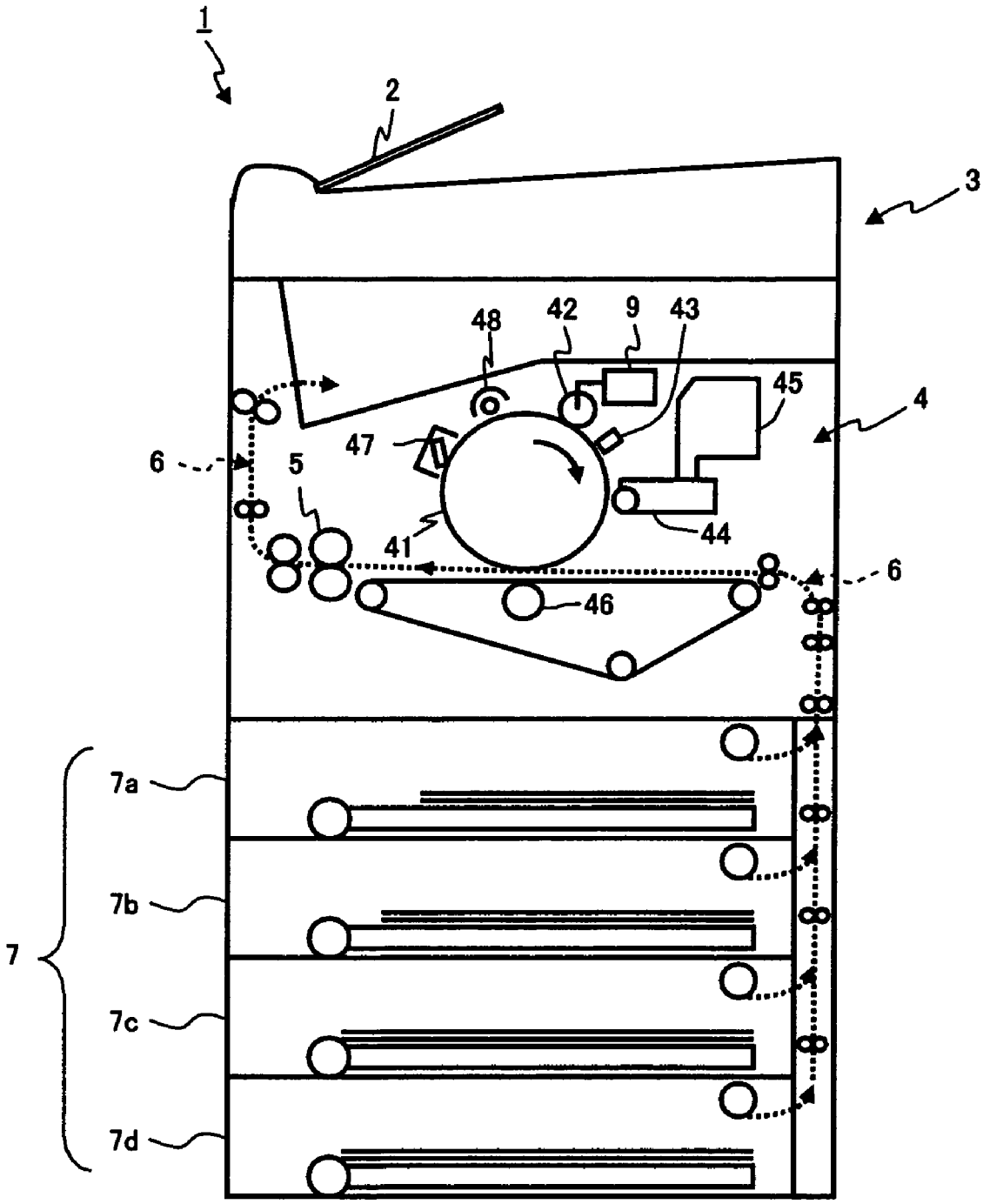
FIG. 5 is an explanatory view showing the digital copying machine of the embodiment.

As shown in FIGS. 4 and 5, a digital copying machine 1 includes functional blocks such as a document placing unit 2, an image scanning unit 3, an image forming portion 4, a fixing unit 5, plural sheet feed cassettes 7 (7*a* to 7*d*), a conveyance unit 6, and a manipulation unit 8. A document is placed on the document placing unit 2. The image scanning unit 3 scans a document image to convert the document image into electronic data. The image forming portion 4 forms a toner image on a sheet based on the image data which is converted into the electronic data by the image scanning unit 3. The fixing unit 5 heats and fixes the toner image formed on the sheet. The plural sheet feed cassettes 7 (7*a* to 7*d*) accommodate different sizes or types of the sheets respectively. The conveyance unit 6 conveys the sheet accommodated in the sheet feed cassettes 7 (7*a* to 7*d*) to the image forming portion 4. Plural menu setting keys are provided in the manipulation unit 8 to set various copy menus.

As shown in FIG. 5, an image bearing body 41 is provided in the image forming portion 4. A charging member 42, a printhead 43, a development unit 44, a transfer unit 46, a cleaner unit 47, and an antistatic lamp 48 are disposed around the image bearing body 41 along a rotating direction of the image bearing body 41.

The image bearing body 41 is formed by a photosensitive drum, and the photosensitive drum is rotated and driven about a shaft of the photosensitive drum by a driving device. In the photosensitive drum, a photosensitive layer is provided on a surface of an aluminum cylinder having a diameter of 30 mm, and the photosensitive layer is formed so as to have a thickness of 20 μm by depositing amorphous silicon which is of a positively-charged photoconductive material.

Figure 1:
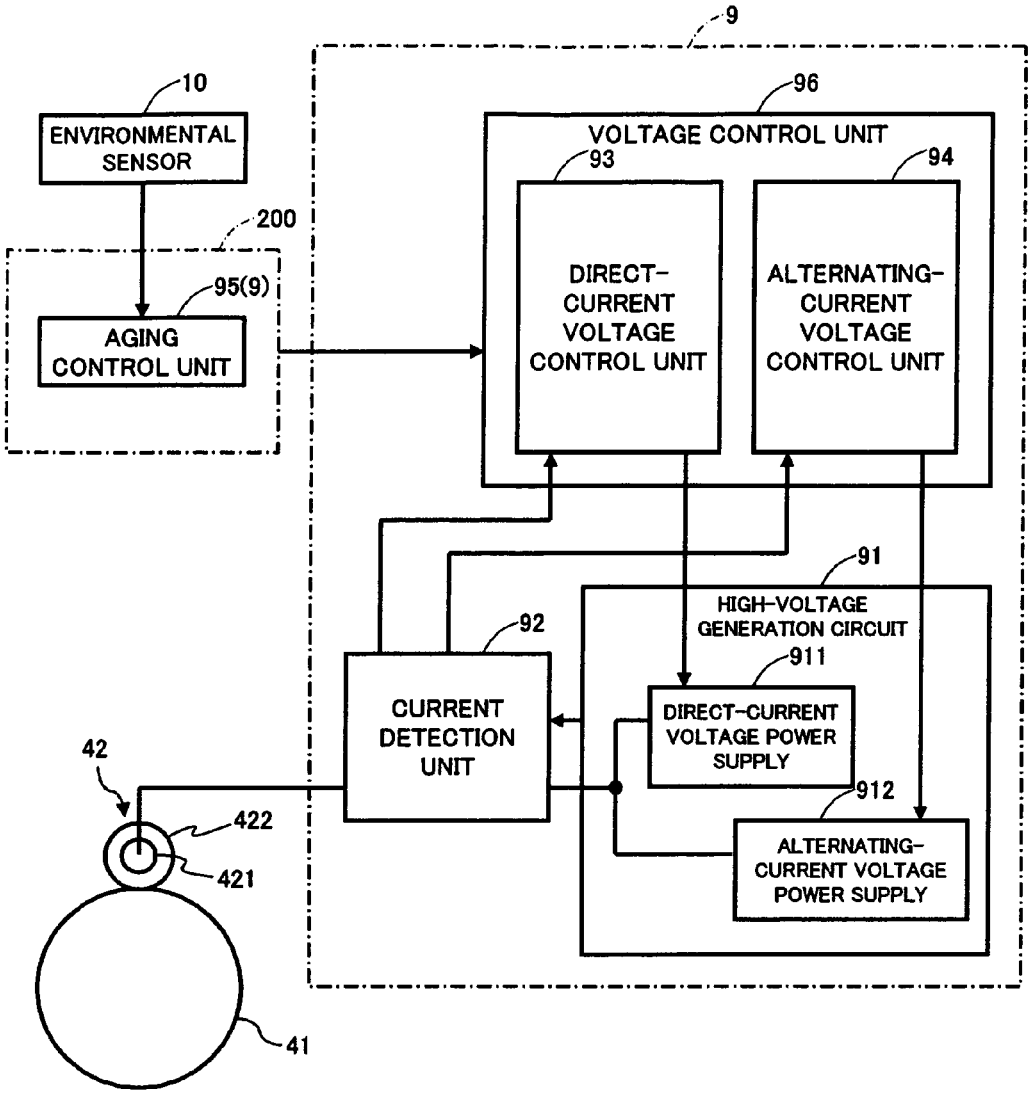
FIG. 1 is a block diagram showing a charging control device of an image forming apparatus according to an embodiment of the invention.
Figure 2:
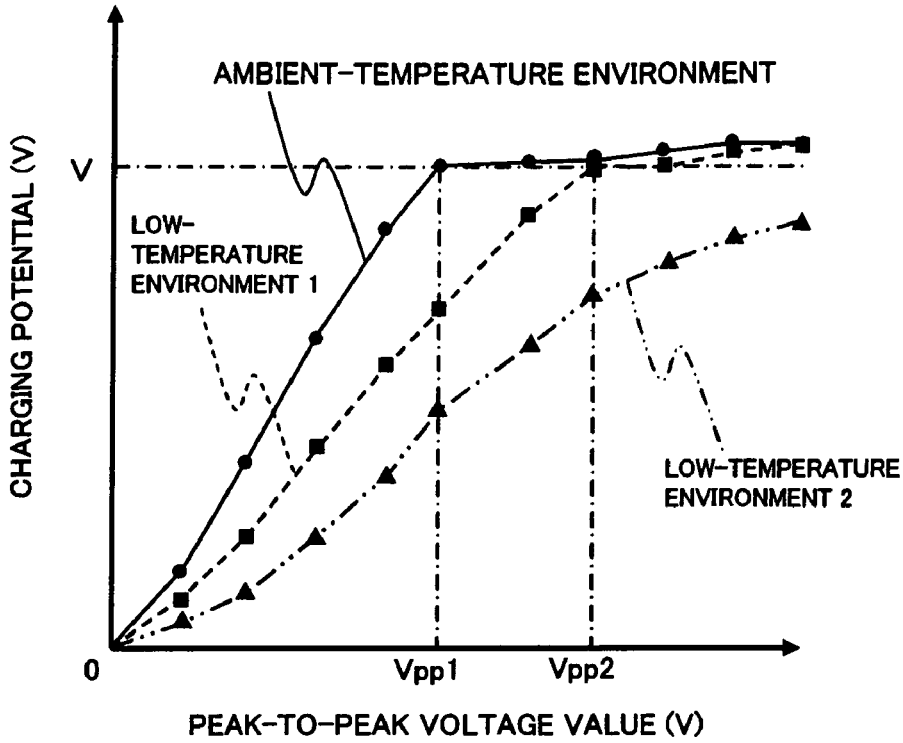
FIG. 2 is a graph showing a relationship between a peak-to-peak voltage value and a charging potential.

The charging member 42 is formed by a charging roller in which a cored bar 421 is coated with an epichlorohydrin-rubber layer 422, and the charging roller is brought into contact with the photosensitive drum with a pressing force of 1 Kgf (see FIG. 1). The epichlorohydrin-rubber layer 422 is an elastic material having electrical conductivity.

A toner cartridge 45 which is of an exchange unit is provided in the development unit 44, and a black toner is stably supplied into the development unit 44.

An image forming process will be described below. The charging member 42 evenly charges the image bearing body 41, and the image bearing body 41 is exposed to form an electrostatic latent image by the printhead 43 driven based on the image data. The development unit 44 visualizes the electrostatic latent image to form a toner image on the image bearing body 41 using the electrostatically adhering toner.

After the transfer unit 46 transfers the toner image formed on the image bearing body 41 to the sheet, the cleaner unit 47 recovers the residual toner, and the antistatic lamp 48 erases a residual potential of the image bearing body 41. A series of image forming processes from the charging to the erase corresponds to the process of printing the image on the one sheet, and the continuous printing process is realized by the series of image forming processes.

Figure 6:
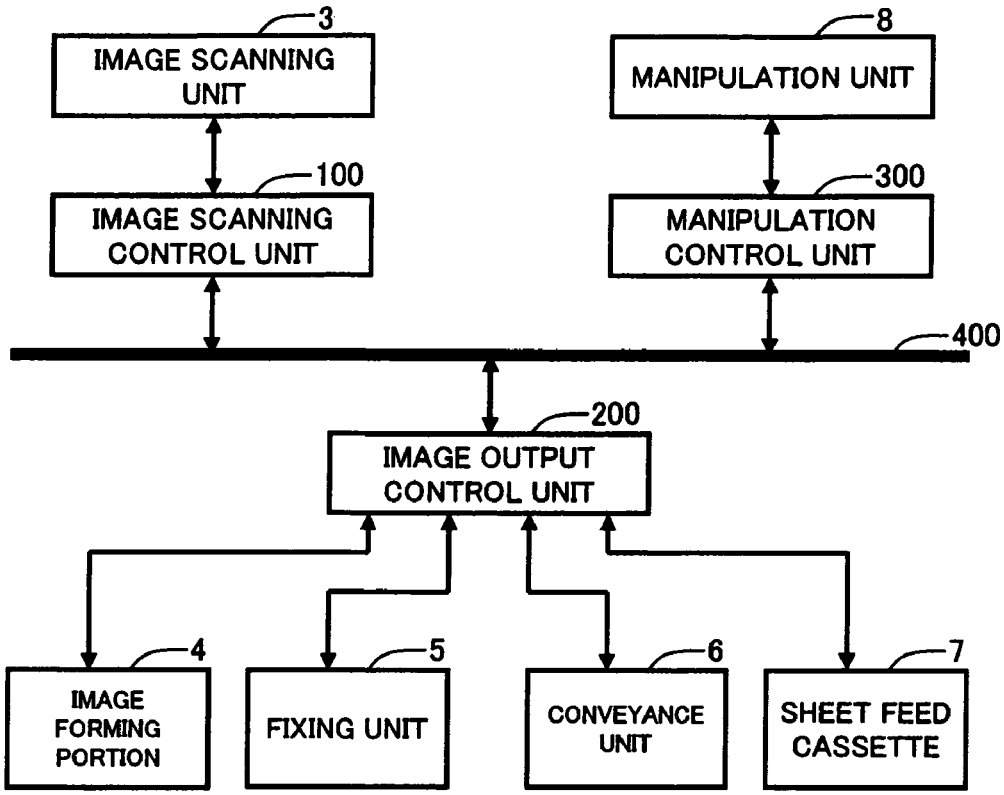
FIG. 6 is a block diagram showing a control unit of the digital copying machine.

As shown in FIG. 6, plural control units are provided in the digital copying machine 1 in order to control the functional blocks. Specifically, an image scanning control unit 100, an image output control unit 200, and a manipulation control unit 300 are provided in the digital copying machine 1. The image scanning control unit 100 controls the document scanning operation performed by the image scanning unit 3. The image output control unit 200 collectively controls the system of the digital copying machine 1, and the image output control unit 200 also controls the image forming portion 4, the fixing unit 5, the conveyance unit 6, and the sheet feed cassettes 7. The manipulation control unit 300 controls input and output signals of the manipulation unit 8.

Each of the control units 100, 200, and 300 is formed by one or more control boards. One or more CPUs, a ROM in which a control program executed by the CPU is stored, a RAM in which control data is stored, and an input and output interface circuit are provided on the control board. The input and output interface circuit outputs a signal to various loads which is of a control target, and detection values are inputted from various sensors to the input and output interface circuit.

The CPUs are connected to one another through a serial communication line 400 to construct a distributed control system. In the digital copying machine 1, the functional blocks are operated in conjunction with one another by the control program executed by each CPU and related hardware, which realizes a predetermined image forming operation.

An output line of the charging control device 9 according to an embodiment of the invention is connected to the charging member 42, and a high voltage is applied to the charging member 42 in order to control a charging voltage to the image bearing body 41.

As shown in FIG. 1, the charging control device 9 includes a high-voltage generation circuit 91, a current detection unit 92, a voltage control unit 96, and an aging control unit 95. The high-voltage generation circuit 91 applies an oscillating voltage to the charging member 42. A direct-current voltage and an alternating-current voltage are superimposed with each other in the oscillating voltage. The current detection unit 92 detects a direct current between the image bearing body 41 and the charging member 42. The voltage control unit 96 controls an output voltage of the high-voltage generation circuit 91. An environmental sensor 10 is disposed near the charging member 42 to detect a temperature and humidity, and detection signals of the environmental sensor 10 are inputted to the voltage control unit 96 through the aging control unit 95.

The high-voltage generation circuit 91 includes a direct-current voltage power supply 911 and an alternating-current voltage power supply 912. The direct-current voltage power supply 911 converts an alternating-current high voltage boosted by a pulse transformer into a direct-current voltage and outputs the direct-current voltage. The alternating-current voltage power supply 912 outputs an alternating-current high voltage boosted by the pulse transformer, and the alternating-current high voltage is formed by a sine wave having a predetermined frequency (1.6 kHz in the embodiment, but not limited to).

The current detection unit 92 detects the direct current passed between the charging member 42 and the image bearing body 41 using the oscillating voltage applied to the charging member 42 from the high-voltage generation circuit 91.

The voltage control unit 96 and the aging control unit 95 are implemented by a CPU incorporated into the image output control unit 200, a peripheral circuit, and a control program. The voltage control unit 96 includes a direct-current voltage control unit 93 which controls an output level of the direct-current voltage power supply 911 and an alternating-current voltage control unit 94 which controls an output level of the alternating-current voltage power supply 912.

The direct-current voltage outputted from the direct-current voltage power supply 911 is set to a threshold voltage Vth at which a discharge is started from the charging member 42 to the image bearing body 41, and a peak-to-peak voltage of the alternating-current voltage outputted from the alternating-current voltage power supply 912 is gradually increased. Therefore, the oscillating voltage applied to the charging member 42 causes the current detection unit 92 to detect a direct current value Idc.

Figure 3:
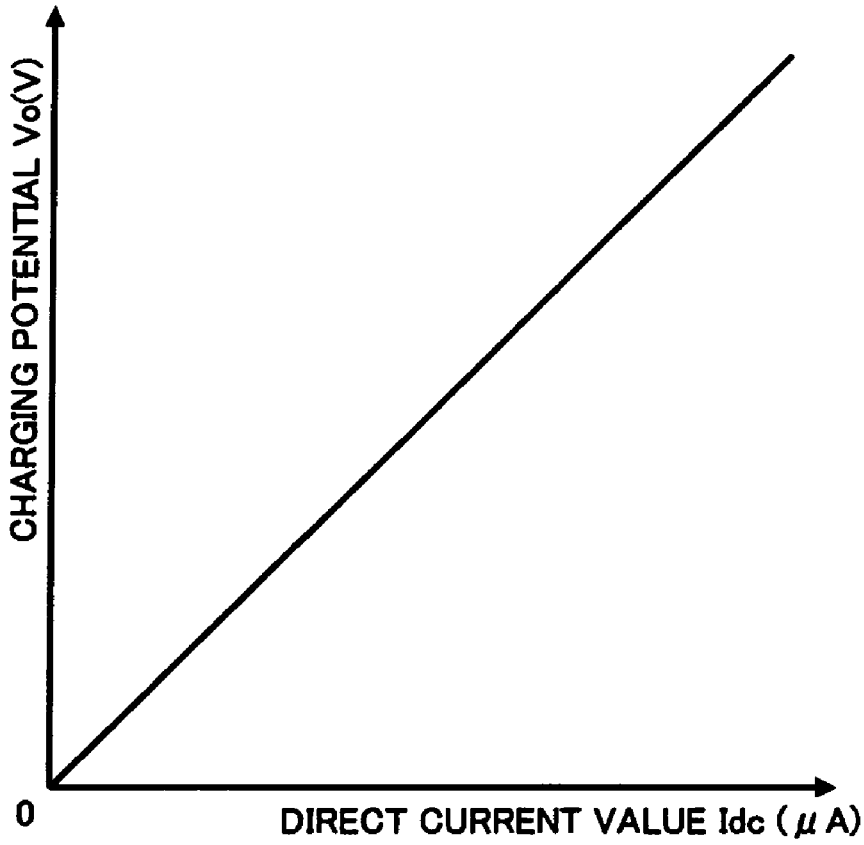
FIG. 3 is a graph showing a relationship between a direct current and a charging potential.

As shown in FIG. 3, through various experiments, the inventors confirm that a proportional relationship exists between the detected direct current value Idc and a charging potential Vo and the proportional relationship is not largely changed by environmental variations such as the temperature and humidity and aging of the image bearing body or charging member.

As described above, in the oscillating voltage applied to the charging member 42, when the peak-to-peak voltage value of the alternating-current voltage is boosted, the charging voltage of the image bearing body 41 is increased in proportion to the peak-to-peak voltage value. When the peak-to-peak voltage value reaches about double the threshold voltage Vth, the charging potential is saturated, and the charging potential is not change any more even if the peak-to-peak voltage value is further boosted.

On the basis of these facts, the peak-to-peak voltage value is adjusted while the direct current value Idc is monitored, which allows the charging potential of the image bearing body 41 to be set to a target potential. The current detection unit 92 is a circuit which detects a direct-current component in the discharge current passed between the charging member 42 and the image bearing body 41, and the current detection unit 92 can be configured simply and at low cost compared with the conventional circuit for detecting an alternating-current component.

The image bearing body 41 exhibits variations in threshold voltage Vth and direct current which should be controlled at proper charging potentials. Accordingly, a ROM in which a proper target voltage (direct-current voltage at the beginning of the discharge) and a target direct current value control range are previously stored is incorporated in each image bearing body 41. A predetermined current range centering on a target current value Idc necessary to adjust the image bearing body 41 to a predetermined surface potential is set as the target direct current value control range.

The voltage control unit 96 adjusts the oscillating voltage, i.e., value of the direct-current voltage and the alternating-current voltage based on the target voltage (direct-current voltage at the beginning of the discharge) and direct current control range read from the ROM.

The direct-current voltage control unit 93 reads the target voltage from the ROM to perform the control such that the output voltage of the direct-current voltage power supply 911 becomes the target voltage. In the embodiment, the target voltage is set to about 400V, but is not limited to.

The alternating-current voltage control unit 94 reads the direct-current voltage value and the target current range from the ROM to maintain the output voltage of the alternating-current voltage power supply 912 at the peak-to-peak voltage value double the direct-current voltage value (about 800V in the embodiment).

When the oscillating voltage is applied to the charging member 42, a discharge current is passed between the charging member 42 and image bearing body 41, and the current detection unit 92 detects a direct-current component of the discharge current.

The alternating-current voltage control unit 94 performs feedback control of the alternating-current voltage power supply 912 such that the direct current detected by the current detection unit 92 falls within the target current range.

Specifically, the alternating-current voltage control unit 94 maintains the peak-to-peak voltage value outputted from the alternating-current voltage power supply 912 when the direct current detected by the current detection unit 92 falls within the target current range, the alternating-current voltage control unit 94 performs control so as to increase the peak-to-peak voltage value when the direct current value is shifted lower than the target current range, and the alternating-current voltage control unit 94 performs control so as to decrease the peak-to-peak voltage value when the direct current value is shifted higher than the target current range.

The voltage control unit 96 rotates and drives the image bearing body 41 in power-on of the apparatus, in transition of the apparatus from a power saving mode to a normal mode, or in start-up of an image forming operation. The voltage control unit 96 turns on and drives the antistatic lamp 48 to adjust the peak-to-peak voltage value such that the image bearing body 41 is kept at a predetermined charging potential based on the direct current value detected by the current detection unit 92. The adjusted peak-to-peak voltage value is stored in the RAM, and the peak-to-peak voltage value is adjusted while the stored peak-to-peak voltage value is used as an initial value in the following image forming operation.

The peak-to-peak voltage value adjusting procedure performed in power-on of the apparatus, or the like is not limited to the above-described procedure. Alternatively, for example, after the output voltage of the direct-current voltage power supply 911 is adjusted to the target voltage, the peak-to-peak voltage value Vpp outputted from the alternating-current voltage power supply 912 is gradually increased, and the peak-to-peak voltage value Vpp may be set to the initial value when the direct current Idc detected by the current detection unit 92 is saturated.

However, as described above, in the low-temperature environment, because the electric resistance value of the epichlorohydrin rubber which is of the charging member 42 becomes increased, the direct-current value cannot be adjusted within the target current range even if the output voltage of the alternating-current voltage power supply 912 is increased by the alternating-current voltage control unit 94. Accordingly, the image bearing body 41 cannot be adjusted to the predetermined target potential.

Therefore, in the power-on of the apparatus, in the transition of the apparatus from the power saving mode to the normal mode, or in the start-up of the image forming operation, when the voltage control unit 96 cannot control the direct-current value Idc within the target current range, or when the temperature detected by the environmental sensor 10 is lower than a predetermined temperature, the aging control unit 95 is started up to perform running-in (hereinafter sometimes referred to as "aging operation") of the charging member 42.

The aging control unit 95 retains the direct-current voltage and alternating-current voltage, outputted from the high-voltage generation circuit 91, at previously-set predetermined voltages through the direct-current voltage control unit 93 and alternating-current voltage control unit 94. The aging control unit 95 also turns on and drives the antistatic lamp 48 to rotate and drive the image bearing body 41.

The conductive ions in the epichlorohydrin-rubber layer are oscillated to lower the electric resistance value by performing the running-in. In the embodiment, the direct-current voltage is controlled at 400V, and the alternating-current voltage is controlled in a voltage higher than by 1.5 kV than the peak-to-peak voltage Vpp at which the charging can stably performed in the ambient temperature environment. The value is the maximum value which can be outputted from the alternating-current voltage power supply 912, the invention is not limited to the value.

For example, in the power-on of the apparatus or in the transition of the apparatus from the power saving mode to the normal mode, when the temperature detected by the environmental sensor 10 is lower than the predetermined temperature, the aging control unit 95 performs the running-in according to a maximum aging time T defined in an aging table stored in the ROM of the image output control unit 200.

As shown in FIG. 7, at ambient temperature lower than 15° C., in the aging table, each aging time T is defined according to a temperature range divided into plural portions. For example, the aging time T is 800 seconds at ambient temperature lower than 3° C., and the aging time T is 200 seconds at ambient temperature not lower than 7° C. to lower than 10° C.

It is not necessary to perform the running-in in a temperature range not lower than 15° C. where the voltage control unit 96 can control the direct-current value Idc within the target current range. However, even in the ambient temperature not lower than 15° C., the running-in may be performed when the voltage control unit 96 cannot control the direct-current value Idc within the target current range.

The aging control unit 95 performs the running-in according to the aging time T defined in the aging table, and the aging control unit 95 monitors the direct current value Idc detected by the current detection unit 92 at predetermined intervals during the running-in.

The aging control unit 95 ends the running-in when the direct current value Idc detected by the current detection unit 92 reaches the target current range. When the aging time T defined in the aging table elapses, the aging control unit 95 ends the running-in even if the direct current value Idc detected by the current detection unit 92 does not reach the target current range.

Then, the digital copying machine 1 makes a transition to a normal start-up operation in the power-on or in recovering from the power saving mode.

Figure 8:
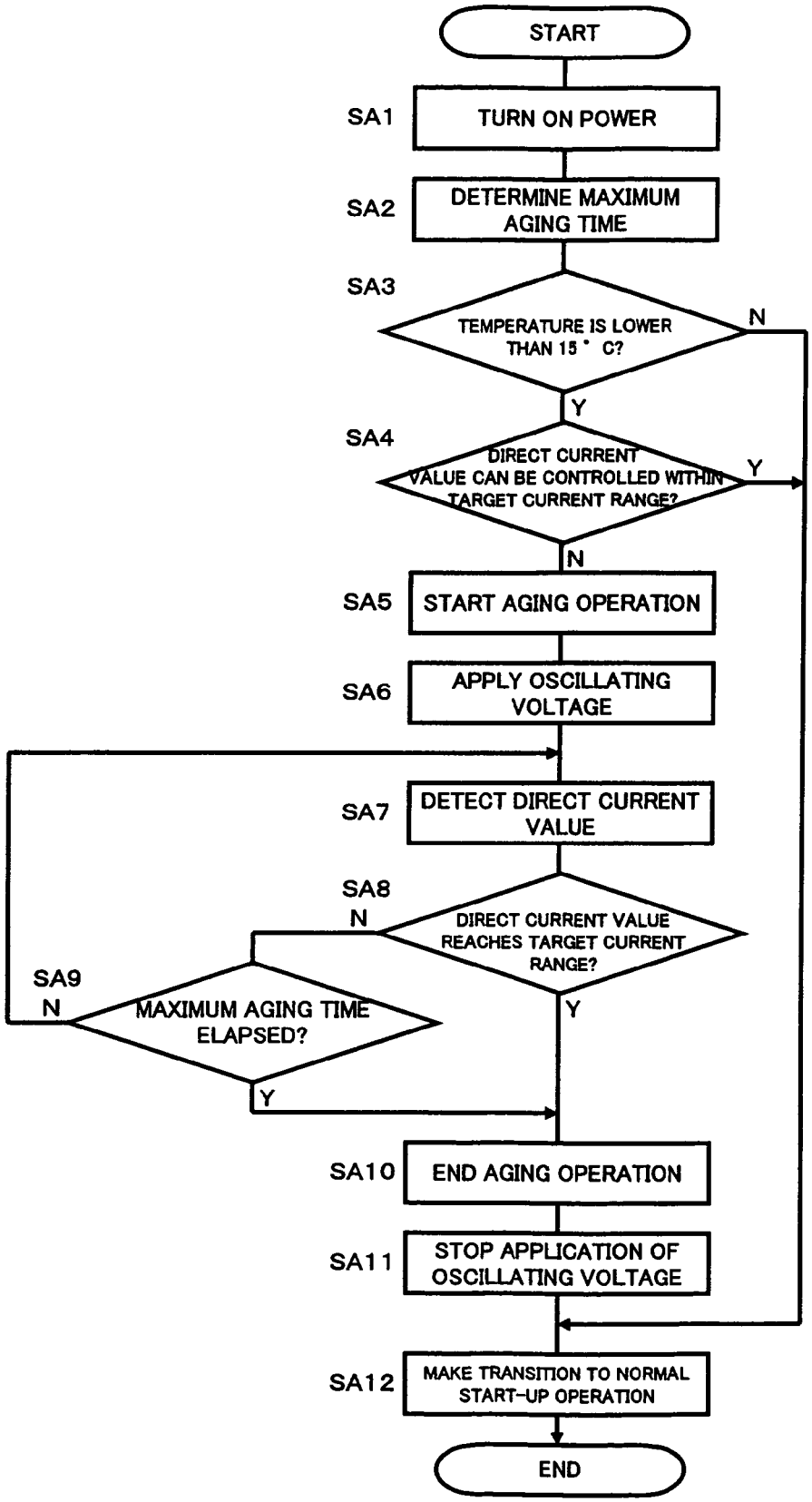
FIG. 8 is a flowchart for explaining an aging operation.

The operation of the aging control unit 95 will be described with reference to a flowchart of FIG. 8.

When the digital copying machine 1 is powered on (SA1), the aging control unit 95 determines the maximum aging time T based on the detection value of the environmental sensor 10 (SA2).

The aging control unit 95 starts the aging operation (SA5), when the ambient temperature detected by the environmental sensor 10 is lower than 15° C. (YES in SA3), and when the voltage control unit 96 cannot control the direct current value Idc within the target current range (NO in SA4).

On the other hand, the aging operation is not performed, when the ambient temperature is not lower than 15° C. (NO in SA3), or when the voltage control unit 96 can control the direct current value Idc within the target current range (YES SA4). Then, the voltage control unit 96 performs the peak-to-peak voltage value adjusting process in step SA12.

When the aging operation is started (SA5), the aging control unit 95 controls the direct-current voltage power supply 911 and alternating-current voltage power supply 912 through the direct-current voltage control unit 93 and alternating-current voltage control unit 94 to apply the oscillating voltage to the charging member 42 (SA6).

Then, the current detection unit 92 detects the direct current value Idc passed from the charging member 42 to the image bearing body 41 (SA7), the aging control unit 95 determines whether or not the direct-current value Idc reaches the target current range in each predetermined time (SA8), and the aging operation is ended (SA10) when the direct current value Idc reaches the target current range (YES in SA8).

On the other hand, when the direct current value Idc does not reach the target current range (NO in SA8), the processes from step SA7 to step SA9 are repeated. When the maximum aging time T elapses (YES in SA9), the aging operation is ended (SA10, and the application of the oscillating voltage to the charging member 42 is stopped (SA11).

Then, the voltage control unit 96 performs the alternating-current adjusting process (SA12). That is, the direct-current voltage is controlled at 400V, and the peak-to-peak voltage of the alternating-current voltage is adjusted such that the direct-current value Idc falls within the target current range.

A tandem-type digital copying machine which is of another example of the image forming apparatus according to an embodiment of the invention into which a charging control device is incorporated will be described below. In the following description, the substantially same component as the monochrome digital copying machine is designated by the same numeral, and the description of the overlapping portion is not given.

Figure 10A:
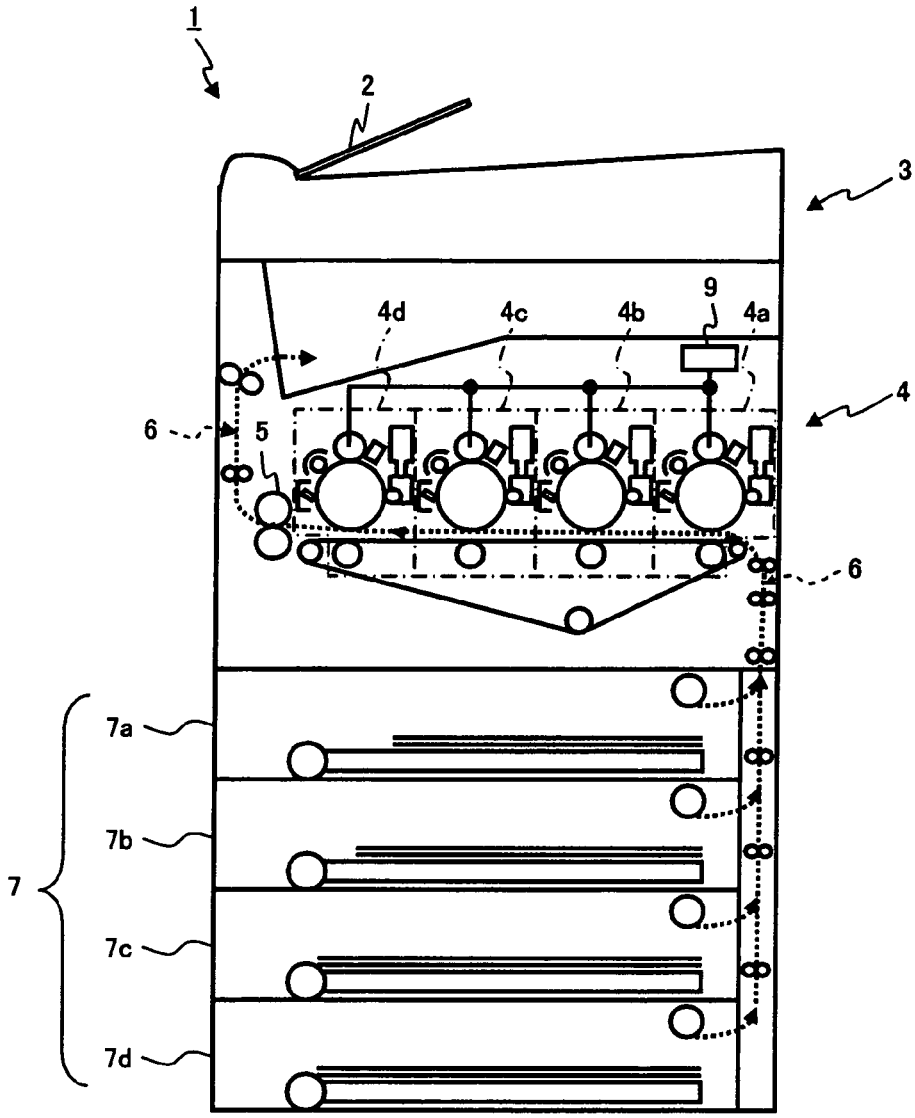
FIG. 10A is an explanatory view showing a color digital copying machine according to an embodiment of the invention.

As shown in FIG. 10A, image forming units 4*a* to 4*d* corresponding to yellow (Y), magenta AM), cyan (C), and black (K) colors are arranged along a sheet conveyance belt in the image forming portion 4.

Figure 10B:
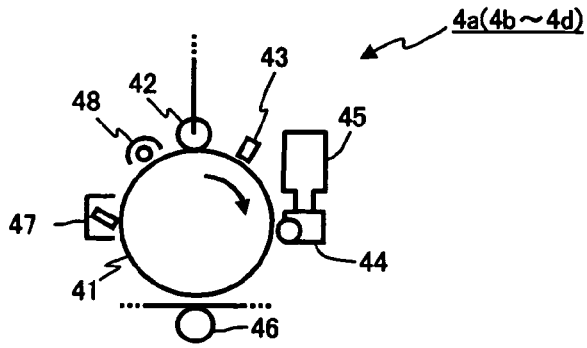
FIG. 10B is an explanatory view showing an image forming unit.

As shown in FIG. 10B, the image bearing body 41 is provided in each of the image forming units 4*a* to 4*d*. The charging member 42, the printhead 43, the development unit 44, the transfer unit 46, the cleaner unit 47, and the antistatic lamp 48 are disposed around the image bearing body 41 along the rotating direction of the image bearing body 41.

The image bearing body 41 is formed by the photosensitive drum, and the photosensitive drum is rotated and driven about a shaft of the photosensitive drum by the driving device. In the photosensitive drum, the photosensitive layer is provided on the surface of the aluminum cylinder, and the photosensitive layer is formed by depositing amorphous silicon which is of the positively-charged photoconductive material.

Similarly to FIG. 1, the charging member 42 is formed by the charging roller in which the cored bar 421 is coated with the epichlorohydrin-rubber layer 422, and the charging roller is disposed in contact with the photosensitive drum. The epichlorohydrin-rubber layer 422 is the elastic material having electrical conductivity.

The toner cartridges 45 which are of the exchange unit are provided in the development unit 44, and color toners are stably supplied into the development unit 44.

An image forming process will be described below.

In each of the image forming units 4*a* to 4*d*, the charging member 42 evenly charges the image bearing body 41, and the image bearing body 41 is exposed to form an electrostatic latent image by the printhead 43 driven based on the image data. The development unit 44 visualizes the electrostatic latent image to form a toner image on the image bearing body 41 using each of the electrostatically adhering yellow (Y), magenta (M), cyan (C), and black (K) toners.

After the transfer unit 46 transfers the toner image formed on the image bearing body 41 to the sheet transferred by the sheet conveyance belt, the cleaner unit 47 recovers the residual toner, and the antistatic lamp 48 erases a residual potential of the image bearing body 41. A series of image forming processes from the charging to the erase corresponds to the process of printing the image on the one sheet, and the continuous full-color printing process is realized by repeating the series of image forming processes in the image forming units 4*a* to 4*d*.

The output line of the charging control device 9 of the embodiment is connected to each charging member 42, and a high voltage is applied to control the charging voltage to the image bearing body 41.

Figure 9:
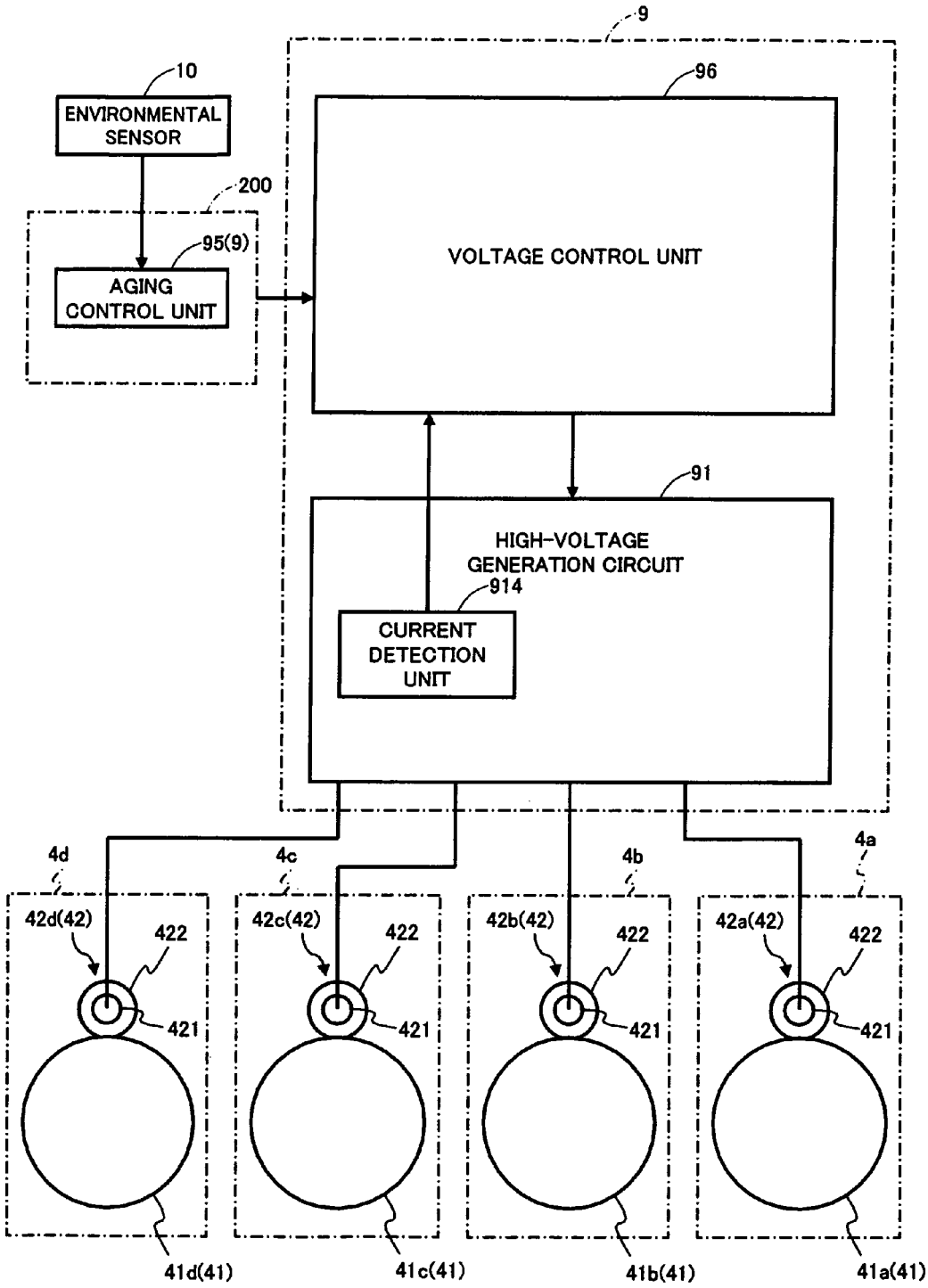
FIG. 9 is a block diagram showing a charging control device of the embodiment.

As shown in FIG. 9, the charging control device 9 includes the high-voltage generation circuit 91, the current detection unit 914, the voltage control unit 96, and the aging control unit 95. The high-voltage generation circuit 91 applies the oscillating voltage to the charging member 42 (42*a* to 42*d*) incorporated into each of the image forming units 4*a* to 4*d*. The direct-current voltage and the alternating-current voltage are superimposed with each other in the oscillating voltage. The current detection unit 914 detects a direct current between the image bearing body 41 (41*a* to 41*d*) and the charging member 42 (42*a* to 42*d*). The voltage control unit 96 controls the output voltage of the high-voltage generation circuit 91.

The environmental sensor 10 is disposed near the charging member 42 to detect the temperature and humidity, and the detection signals of the environmental sensor 10 are inputted to the voltage control unit 96 through the aging control unit 95.

The voltage control unit 96 and the aging control unit 95 are implemented by the CPU incorporated into the image output control unit 200, the peripheral circuit, and the control program.

Figure 11:
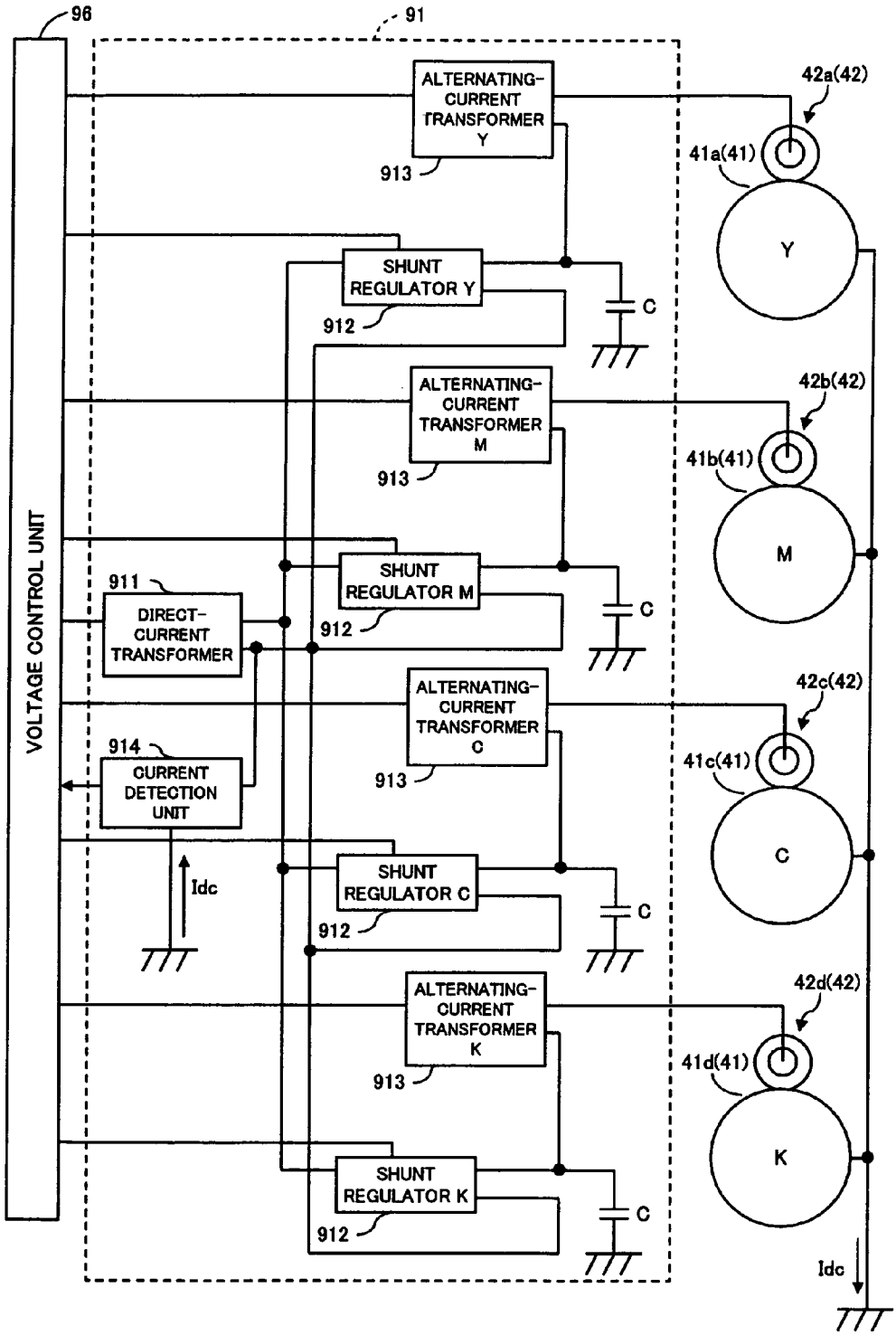
FIG. 11 is a block diagram showing a high-voltage generation circuit.

As shown in FIG. 11, the high-voltage generation circuit 91 includes a direct-current voltage power supply and an alternating-current voltage power supply. The direct-current voltage power supply converts an alternating-current high voltage boosted by a pulse transformer into a direct-current voltage and outputs the direct-current voltage. The alternating-current voltage power supply outputs an alternating-current high voltage boosted by the pulse transformer, and the alternating-current high voltage is formed by a sine wave having a predetermined frequency (1.6 kHz in the embodiment, but is not limited to).

The direct-current voltage power supply includes single direct-current transformer 911 and four linear direct-current regulators 912 connected in parallel on a secondary side of the direct-current transformer 911.

Figure 12:
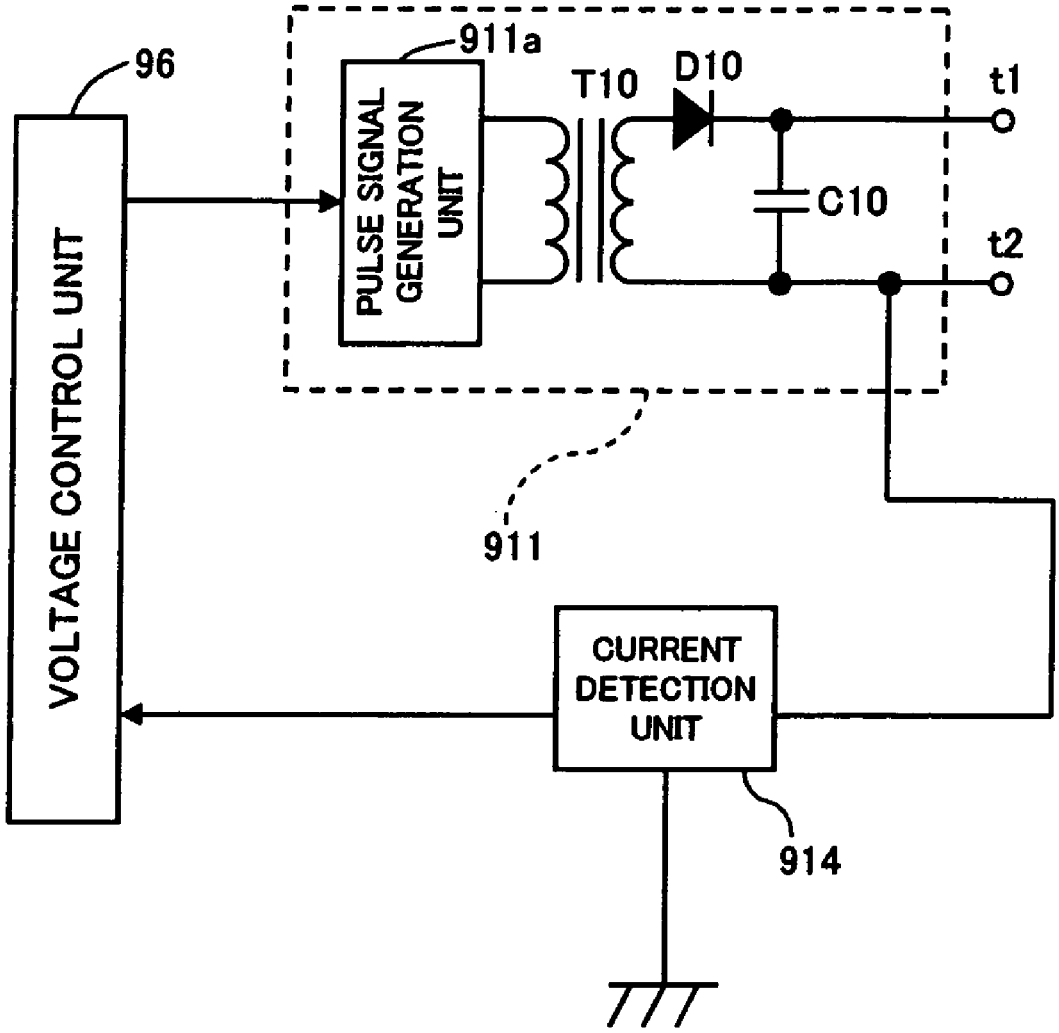
FIG. 12 is a circuit diagram showing a direct-current transformer.

As shown in FIG. 12, an output of a pulse signal generation unit 911*a* is connected to a primary winding of the direct-current transformer 911, a high-voltage alternating-current voltage outputted from a secondary winding is smoothed by a diode D10 and a capacitor C10, and a high-voltage direct-current voltage is outputted from output terminals t1 and t2.

The pulse signal generation unit 911*a* outputs a constant-level pulse signal to drive the direct-current transformer 911 based on a remote signal inputted from the voltage control unit 96. Accordingly, the direct-current voltage outputted from the direct-current transformer 911 is kept constant.

Figure 13:
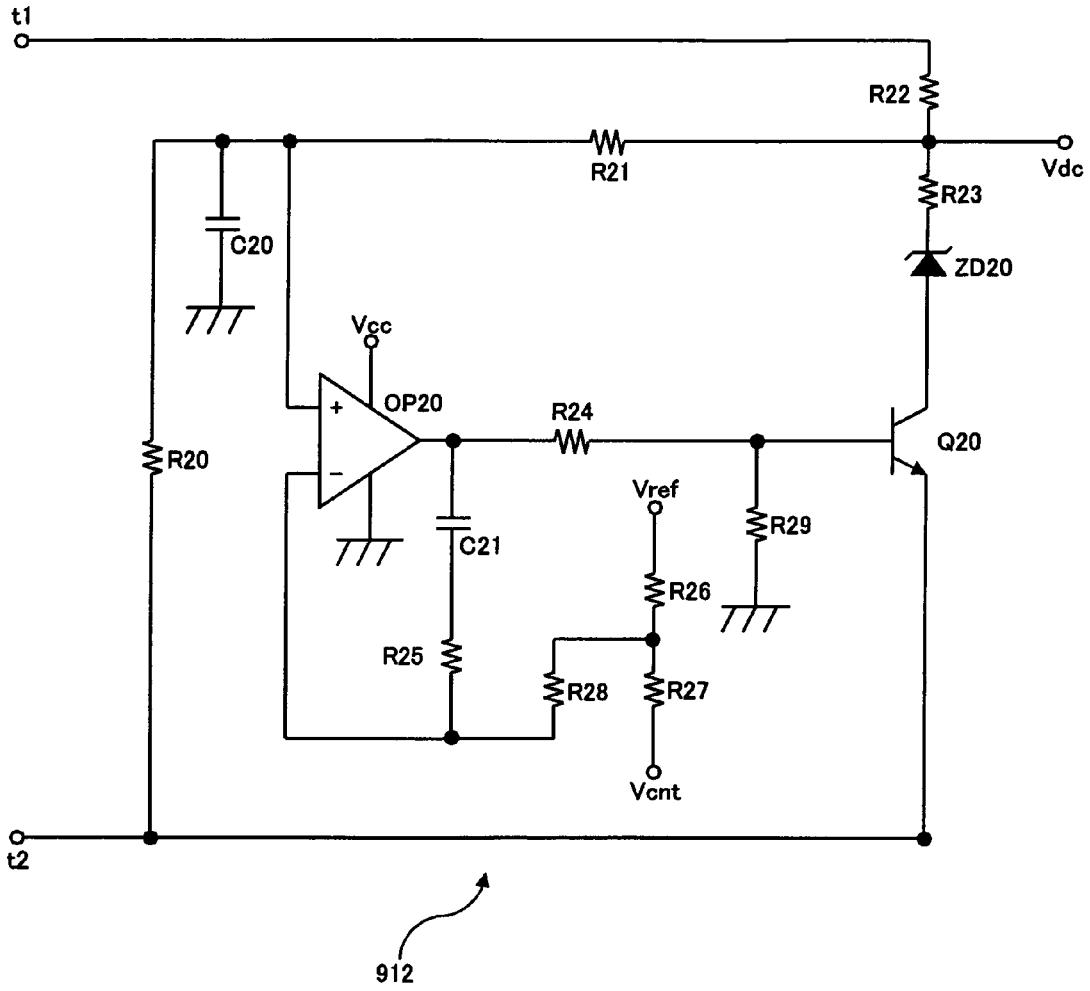
FIG. 13 is a circuit diagram showing a shunt regulator.

Each linear direct-current regulator 912 is formed by a shunt regulator 912. As shown in FIG. 13, the linear direct-current regulator 912 includes an operational amplifier OP20 which acts as a differential amplifier, a pass transistor Q20 which is driven by an output current of the operational amplifier OP20, a Zener diode ZD20 (breakdown voltage of 250V) which is connected to a collector of the pass transistor Q20.

The shunt regulator is described only by way of example, and another type of linear direct-current regulator may be used.

A divided-voltage into which the output voltage of the shunt regulator 912 is divided by resistors R21 and R20 is inputted to a noninverting input terminal of the operational amplifier OP20, and a reference voltage is inputted to the noninverting input terminal.

Accordingly, a base current is supplied from the operational amplifier OP20 to the pass transistor Q20 such that the reference voltage and the divided-voltage are equal to each other, and whereby the direct-current voltage Vdc is adjusted by the current passed through the resistor R23 and Zener diode ZD20.

The reference voltage is adjusted in a variable manner by a comparative voltage Vref (fixed value) and control voltages Vcnt controlled by the voltage control unit 96, and the control voltages Vcnt are separately adjusted. Therefore, a direct-current voltage Vdc applied to each charging member 42 is adjusted variably and stably in the range of 250V to 750V.

As shown in FIG. 11, the alternating-current voltage power supply includes alternating-current transformers 913 according to the number of image bearing bodies 41.

The output of the pulse signal generation unit is connected to a primary winding of the alternating-current transformer 913, and a high-voltage alternating-current voltage is outputted from a secondary winding. The pulse signal generation unit outputs a variable-level pulse signal to drive the alternating-current transformer 913 based on the remote signal and voltage control signal inputted from the voltage control unit 96. Accordingly, the alternating-current voltage outputted from the alternating-current transformer 913 is controlled in a variable manner.

An output terminal of the shunt regulator 912 is connected to a secondary-side terminal of each alternating-current transformer 913 through a capacitor C bypassing the alternating-current voltage, and the oscillating voltage in which the direct-current voltage of the shunt regulator 912 and the alternating-current voltage of the alternating-current transformer 913 are superimposed is applied to each charging member 42.

Additionally, a single current detection unit 914 is provided in the high-voltage generation circuit 91 to detect the direct-current component in the discharge current passed from each charging member 42 to each image bearing body 41.

Figure 14:
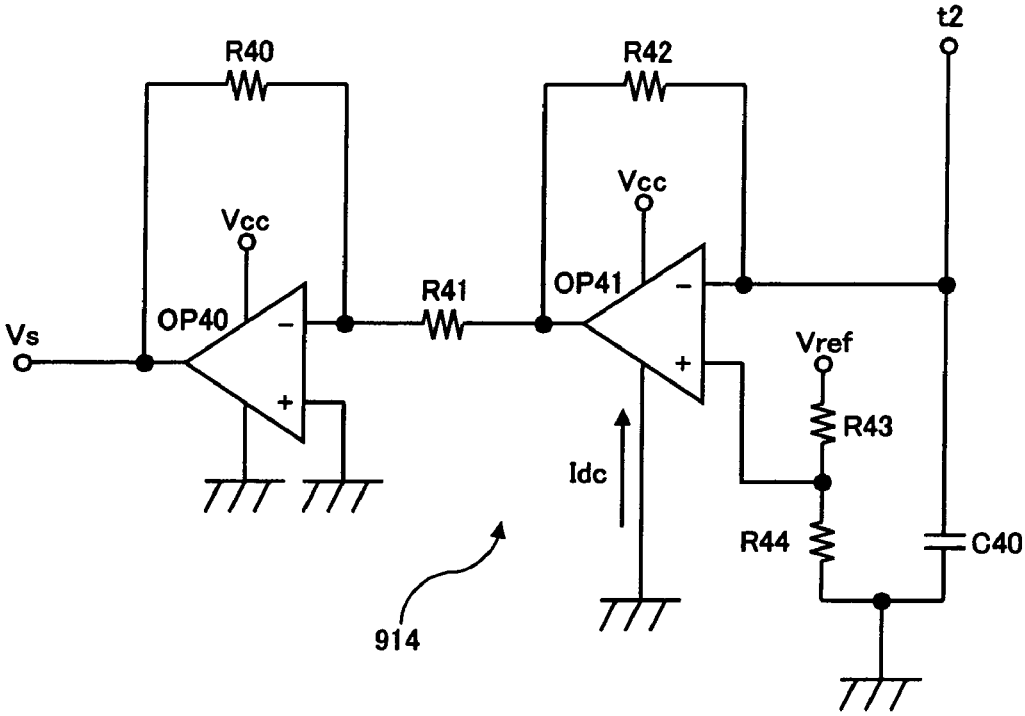
FIG. 14 is a circuit diagram showing a current detection circuit.

As shown in FIG. 14, the current detection circuit 914 includes a current-voltage converting operational amplifier OP41 and an amplifying operational amplifier OP40.

The low-voltage terminal t2 of the secondary winding of the direct-current transformer 911 is connected to a noninverting input terminal of the operational amplifier OP41, and the reference voltage is inputted to the noninverting input terminal. The reference voltage is a divided-voltage into which the comparative voltage Vref is divided by resistors R43 and R44.

The current value passed through the feedback resistor R42 is converted into the voltage such that the reference voltage is equal to the voltage between the secondary low-voltage side terminals t2, and the voltage is amplified by the operational amplifier OP40 and inputted to the voltage control unit 96.

The detection of the direct current Idc will be described in detail. In the operational amplifier OP41, the direct current Idc between the charging member 42 and the image bearing body 41 is passed from the image bearing body 41 to the ground and passed to the output terminal from the ground-side terminal of the control voltage applied to the operational amplifier OP41. The direct current Idc is passed to the low-voltage side of the direct-current transformer 911 through the resistor R42 to form a loop of the direct-current component of the high-voltage generation circuit 91.

A voltage-current conversion table with which the voltage value detected by the current detection unit 914 is converted into the current value is previously stored in the ROM, and the voltage control unit 96 determines the direct-current value Idc from the output voltage of the operational amplifier OP40 based on the voltage-current conversion table.

The current detection unit 914 detects the total value of the direct currents passed from the charging members 42 to all the image bearing bodies 41 of the image forming units 4*a* to 4*d*.

Accordingly, when the current detection unit 914 separately measures the direct currents Idc passed between the charging members 42 and the image bearing bodies 41 of the image forming units 4*a* to 4*d*, the outputs of the shunt regulators 912 and alternating-current transformers 913 are adjusted lower than the discharge start voltage except for the shunt regulator 912 and alternating-current transformer 913 corresponding to the charging member 42 which becomes the measurement target of the voltage control unit 96.

Specifically, the control voltages Vcnt of the three shunt regulators 912 except for the shunt regulator 912 which becomes the measurement target of the voltage control unit 96 are adjusted so as to become about 250V lower than the discharge start voltage, and the values of the current detection unit 914 are read after the three alternating-current transformers 913 except for the alternating-current transformer 913 which becomes the measurement target are turned off.

The voltage control unit 96 performs the adjustment such that the output of each shunt regulator 912 and output of each alternating-current transformer 913 are maintained at predetermined target values based on each direct-current value Idc passed from the charging member 42 to the image bearing body 41.

Specifically, a direct current value control range having a proper target voltage (direct-current voltage at the beginning of the discharge) is previously stored in the ROM, and the ROM is incorporated in each image bearing body 41.

The voltage control unit 96 controls each shunt regulator 912 such that the target voltage value (about 500V in the embodiment) read from the ROM of each image bearing body 41 is outputted.

The voltage control unit 96 also reads the target voltage value and target current range from the ROM of each image bearing body 41 to control the alternating-current transformer 913 such that the alternating-current voltage (about 1000V in the embodiment) whose peak-to-peak voltage Vpp becomes double the target voltage value is outputted.

In the power-on of the apparatus, in the transition of the apparatus from the power saving mode to the normal mode, or in the start-up of the image forming operation, the voltage control unit 96 turns on and drives the antistatic lamp 48 while rotating and driving the image bearing body 41 in each of the image forming units 4*a* to 4*d*. On the basis of the direct current value detected by the current detection unit 914, the voltage control unit 96 performs the feedback control of each peak-to-peak voltage such that the image bearing body 41 is maintained at a predetermined charging potential. Each of the adjusted peak-to-peak voltage value is stored in the RAM, and the peak-to-peak voltage value is adjusted while the stored peak-to-peak voltage value is used as the initial value in the following image forming operation.

The peak-to-peak voltage adjusting procedure performed in power-on of the apparatus, or the like is not limited to the above-described procedure. Alternatively, for example, after the output voltage of the shunt regulator 912 is adjusted to the target voltage, the peak-to-peak voltage value Vpp outputted from the alternating-current transformer 913 is gradually increased, and the peak-to-peak voltage value Vpp may be set to the initial value when the direct current Idc detected by the current detection unit 914 is saturated.

Additionally, the antistatic lamps 48 are turned on and driven while all the image bearing bodies 41 of the image forming units 4*a* to 4*d* are rotated and driven, and the peak-to-peak voltage value Vpp outputted from each alternating-current transformer 913 may be adjusted. In this case, when each direct current Idc is separately detected, the oscillating voltage applied to the charging member 42 which is not the measurement target is turned off.

However, similarly to the previous embodiment, in the low-temperature environment, because the electric resistance value of the epichlorohydrin rubber which is of the charging member 42 becomes increased, the direct-current value Idc cannot be adjusted within the target current range even if the output voltage of the alternating-current transformer 913 is increased to the maximum peak-to-peak voltage. Accordingly, the image bearing body 41 cannot be adjusted to the predetermined target potential.

Therefore, in the power-on of the apparatus, in the transition of the apparatus from the power saving mode to the normal mode, or in the start-up of the image forming operation, when the voltage control unit 96 cannot control the direct-current value Idc within the target current range, or when the temperature detected by the environmental sensor 10 is lower than a predetermined temperature, the aging control unit 95 is started up to perform running-in of the charging member 42.

The aging control unit 95 retains the direct-current voltage and alternating-current voltage, outputted from the high-voltage generation circuit 91, at previously-set predetermined voltages. The aging control unit 95 also turns on and drives the antistatic lamp 48 to rotate and drive the image bearing body 41.

The conductive ions in the epichlorohydrin-rubber layer are oscillated to lower the electric resistance value by performing the running-in. In the embodiment, the direct-current voltage is controlled at 500V, and the alternating-current voltage is controlled in a voltage higher than by 1.5 kV the peak-to-peak voltage Vpp at which the charging can stably performed in the ambient temperature environment. The value is the maximum value which can be outputted from the alternating-current transformer 913, but the invention is not limited to the value.

For example, in the power-on of the apparatus or in the transition of the apparatus from the power saving mode to the normal mode, when the temperature detected by the environmental sensor 10 is lower than the predetermined temperature, the aging control unit 95 performs the running-in according to the maximum number of aging times T defined in an aging table stored in the ROM of the image output control unit 200.

As shown in FIG. 15, at ambient temperature lower than 15° C., in the aging table, the number of aging times N is defined according to a temperature range divided into plural portions. For example, the number of aging times N is 30 times at ambient temperature lower than 3° C., and the number of aging times N is 6 times at ambient temperature not lower than 7° C. to lower than 10° C. In this case, although the reference time per aging is set to 30 seconds, the invention is not limited to the 30 seconds.

It is not necessary to perform the running-in in a temperature range not lower than 15° C. where the voltage control unit 96 can control the direct current value Idc within the target current range. However, even in the ambient temperature not lower than 15° C., the running-in may be performed when the voltage control unit 96 cannot control the direct current value Idc within the target current range.

The aging control unit 95 turns on and drives the antistatic lamp 48 while rotating and driving all the image bearing bodies 41 of the image forming unit 4*a* to 4*d*, and the aging control unit 95 adjusts the output voltages of the shunt regulators 912 to the target voltages. Then, the aging control unit 95 adjusts the peak-to-peak voltage Vpp outputted from the alternating-current transformer 913 to the maximum value of 1.5 kV and performs the running-in for 30 seconds.

When the 30 seconds elapsed, the aging control unit 95 turns off the outputs of the shunt regulators 912 and alternating-current transformers 913 corresponding to the three image forming units 4*b* to 4*d* except for the image forming unit 4*a*, or the aging control unit 95 decreases the outputs of the shunt regulators 912 and alternating-current transformers 913 corresponding to the three image forming units 4*b* to 4*d* to levels lower than the discharge start voltage. Then, the aging control unit 95 monitors the direct current Idc corresponding to the specific image forming unit 4*a* for one second using the current detection unit 914.

Then, the aging control unit 95 turns off the outputs of the shunt regulators 912 and alternating-current transformers 913 corresponding to the three image forming units 4*a*, 4*c*, and 4*d* except for the image forming unit 4*b*, or the aging control unit 95 decreases the outputs of the shunt regulators 912 and alternating-current transformers 913 corresponding to the three image forming units 4*a*, 4*c*, and 4*d* to levels lower than the discharge start voltage. Then, the aging control unit 95 monitors the direct current Idc corresponding to the specific image forming unit 4*b* for one second using the current detection unit 914. The cycle of the above-described operations is repeated by the number of aging times N set in the aging table.

The aging control unit 95 ends the running-in, when all the direct currents Idc of the image forming units 4*a* to 4*d* reach the target current ranges, or when the number of cycles reaches the number of aging times N.

Then, the digital copying machine 1 makes a transition to a normal start-up operation in the power-on or in recovering from the power saving mode.

Figure 16:
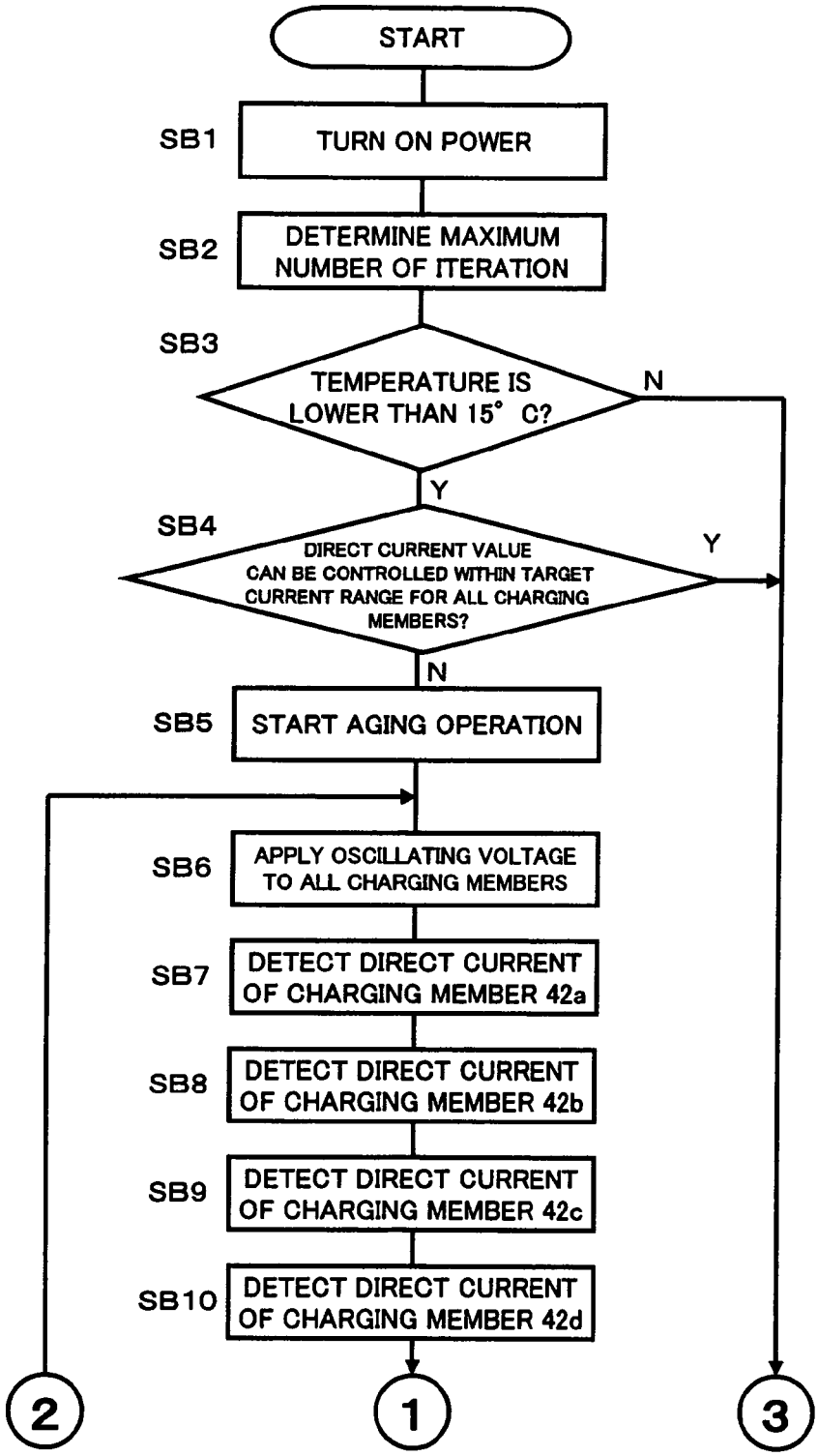
FIG. 16 is a flowchart showing an aging operation.
Figure 17:
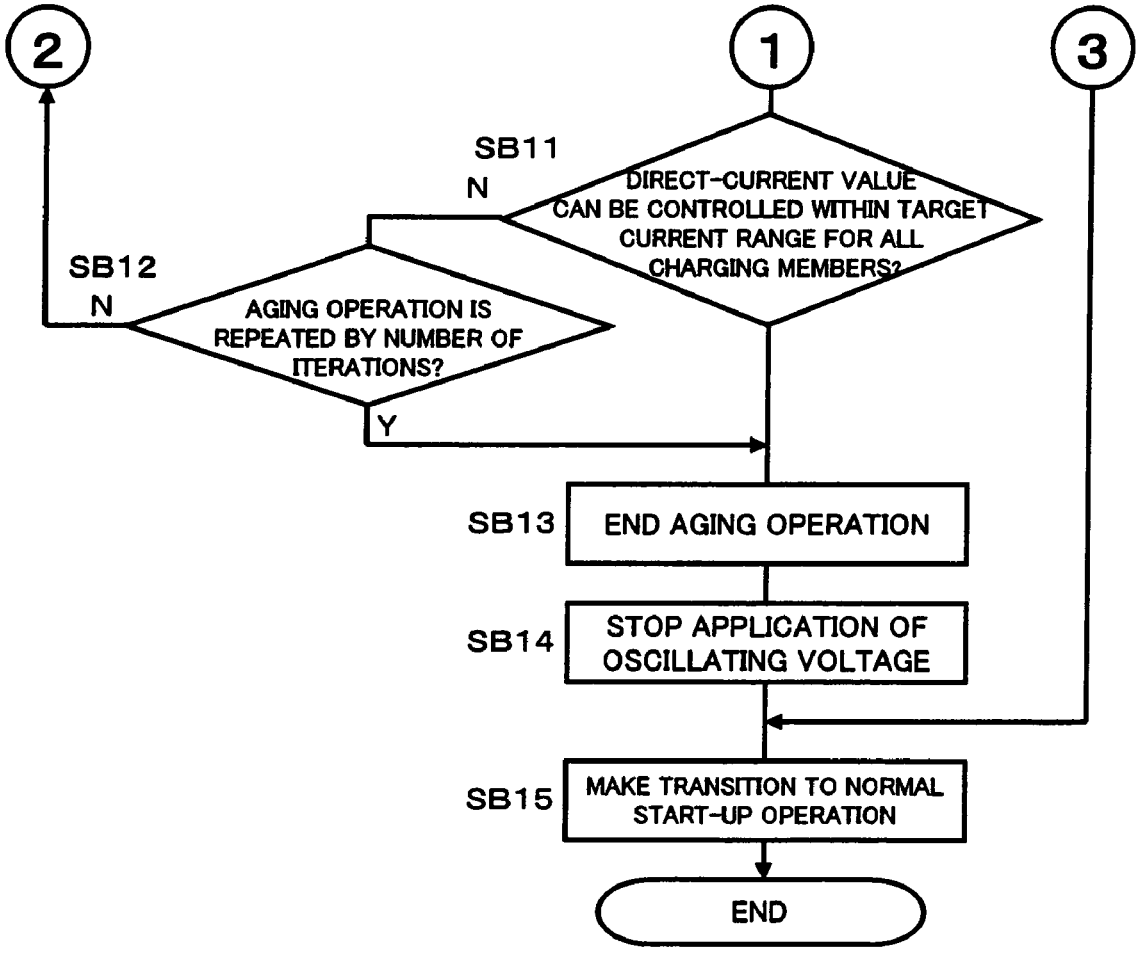
FIG. 17 is a flowchart showing the aging operation.

The operation of the aging control unit 95 will be described with reference to flowcharts of FIGS. 16 and 17.

When the color digital copying machine 1 is powered on (SB1), the aging control unit 95 determines the maximum number of iterations N based on the detection value of the environmental sensor 10 (SB2).

The aging control unit 95 starts the aging operation to all the image bearing bodies 41*a* to 41*d* and all the charging members 42*a* to 42*d* (SB5), when the ambient temperature detected by the environmental sensor 10 is lower than 15° C. (YES in SB3), and when the voltage control unit 96 cannot controls the direct current value Idc corresponding to one of the charging members 42 within the target current range (NO in SB4).

On the other hand, the aging operation is not performed, when the ambient temperature is not lower than 15° C. (NO in SB3), or when the voltage control unit 96 can controls the direct current values Idc corresponding to all the charging members 42 within the target current range (YES in SB4). Then, the voltage control unit 96 performs the peak-to-peak voltage value adjusting process in step SB15.

When the aging operation is started (SB5), the aging control unit 95 applies the oscillating voltages for 30 seconds to the charging members 42*a* to 42*d* from the high-voltage generation circuit 91 through the voltage control unit 96 (SB6).

Then, the aging control unit 95 turns off the oscillating voltages applied to the charging members 42*b* to 42*d* except for the specific charging member 42*a*, or the aging control unit 95 adjusts the oscillating voltages to a voltage lower than the discharge start voltage. In this state of things, the direct current value Idc (direct current value Idc passed between charging member 42*a* and the image bearing body 41*a*) detected by the current detection unit 914 is monitored for one second (SB7).

Similarly to step SB7, the aging control unit 95 turns off the oscillating voltages applied to the charging members 42 except for the specific charging member 42*b*, or the aging control unit 95 adjusts the oscillating voltages to a voltage lower than the discharge start voltage. In this state of things, the direct current value Idc (direct current value Idc passed between charging member 42*b* and the image bearing body 41*b*) detected by the current detection unit 914 is monitored for one second (SB8). The similar process is performed to the charging members 42*c* and 42*d* (SB9 and SB10).

The aging control unit 95 ends the aging operation (SB13), when all the direct current values Idc corresponding to the monitored charging member 42 reach the target current ranges (YES in SB11).

On the other hand, when one of the direct current values Idc does not reach the target current range (NO in SB11), the aging control unit 95 repeats the one-cycle aging operation from step SB6 to step SB11 by the number of aging times N set in the aging table (SB12).

After the number of cycles reaches the number of aging times N, the aging control unit 95 ends the aging operation (SB13), and the aging control unit 95 stops the application of the oscillating voltage to charging member 42 (SB14).

Then, the voltage control unit 96 performs the alternating-current adjusting process (SB15). That is, the direct-current voltage is controlled at 500V, and the peak-to-peak voltage of the alternating-current voltage is adjusted such that the direct current value Idc falls within the target current range.

Other embodiments will be described below. In the above-described embodiments, the voltage control unit 96 adjusts the alternating-current voltage such that the direct current value Idc is maintained in the target current range. Furthermore, the direct-current voltage may be controlled such that the direct current value Idc is maintained in the target current range as well as the alternating-current voltage adjustment.

In the above-described embodiments, the relationship between the ambient temperature and the aging time or the number of aging times is defined by the aging table. The aging table may be configured while the environmental humidity is added.

In the above-described embodiments, the photosensitive drum in which the photosensitive layer is made of amorphous silicon is used as the image bearing body 41. The invention can be applied to the image forming apparatus including the photosensitive body made of a material except for the amorphous silicon photosensitive material. For example, the invention can be applied to an image forming apparatus made of an organic photosensitive material or a selenium photosensitive material. Particularly, the invention can effectively be applied to the amorphous silicon photosensitive material having the hard surface layer.

In the above-described embodiments, the charging member 42 is formed by the charging roller in which the cored bar 421 is coated with the epichlorohydrin-rubber layer 422. Alternatively, the charging member 42 may be formed by the charging roller with which the epichlorohydrin-rubber layer 422 is coated.

When the aging control unit 95 cannot control the direct current value Idc so as to fall within the target current range, the voltage control unit 96 may control the direct current value Idc to the maximum peak-to-peak voltage, or a message that the charging potential is not normally set may be displayed on the manipulation unit 8.

The charging member 42 is not always disposed in contact with the image bearing body 41, but the charging member 42 may be brought close to the image bearing body 41 with a small gap.

The waveform of the alternating-current voltage superimposed with the direct-current voltage in the form of the oscillating voltage is not limited to the sine wave, but any waveform such as rectangular wave, a triangular wave, and a pulsating wave may be used.

What is claimed is:

1. An image forming apparatus including a charging member which is disposed while brought into contact with or close to an image bearing body, the image forming apparatus comprising:

a high-voltage generation circuit which applies an oscillating voltage to the charging member, a direct-current voltage and an alternating-current voltage being superimposed to form the oscillating voltage;

a current detection unit which detects a direct current value passed from the charging member to the image bearing body;

a voltage control unit which controls a peak-to-peak voltage value of the alternating-current voltage applied from the high-voltage generation circuit to the charging member such that the direct current value detected by the current detection unit falls within a target current range; and an aging control unit which rotates and drives the image bearing body while retaining the alternating-current voltage and the direct-current voltage at previously-set predetermined voltages.

2. The image forming apparatus according to claim 1, wherein the aging control unit performs aging operation, when the voltage control unit cannot control the direct current value within the target current range, or when ambient temperature of the image forming apparatus is lower than a predetermined temperature.

3. The image forming apparatus according to claim 1, wherein the aging control unit performs aging operation in powering on the image forming apparatus or in recovering from a power saving mode.

4. The image forming apparatus according to claim 1, wherein the aging control unit ends aging operation, when a direct current value detected by the current detection unit reaches the target current range, or when a previously-set predetermined time elapses.

5. The image forming apparatus according to claim 4, wherein the predetermined time is set based on ambient temperature of the image forming apparatus.

6. A tandem-type color image forming apparatus including a charging member which is disposed while brought into contact with or close to each of a plurality of image bearing bodies sequentially arranged along a sheet conveyance direction, the tandem-type color image forming apparatus comprising:

a high-voltage generation circuit which separately applies an oscillating voltage to each charging member, a direct-current voltage and an alternating-current voltage being superimposed to form the oscillating voltage;

a current detection unit which can detect a direct current value passed from each charging member to each image bearing body;

a voltage control unit which separately controls a peak-to-peak voltage value of the alternating-current voltage applied from the high-voltage generation circuit to each charging member such that the direct current value detected by the current detection unit falls within a target current range; and an aging control unit which rotates and drives the image bearing body while retaining the alternating-current voltage and the direct-current voltage at previously-set predetermined voltages.

7. The color image forming apparatus according to claim 6, wherein the high-voltage generation circuit includes:

a single direct-current transformer in which a plurality of linear direct-current regulators are connected in parallel on a secondary side;

a plurality of alternating-current transformers in which an output of each linear direct-current regulator is separately connected to the secondary side;

a single current detection circuit which is connected onto the secondary side of the direct-current transformer to detect a direct current value passed from the charging member to the image bearing body, and outputs except for one output of one of the linear direct-current regulators are adjusted lower than a discharge start voltage to separately detect the direct current.

8. The color image forming apparatus according to claim 6, wherein the aging control unit rotates and drives each image bearing body only for a previously-set reference time while retaining the alternating-current voltage and the direct-current voltage at a previously-set predetermined voltage, and then the aging control unit adjusts outputs except for one output of one of the linear direct-current regulators lower than a discharge start voltage to repeat one cycle of aging operation set times, the direct currents being sequentially detected in the one cycle of the aging operation.

9. The color image forming apparatus according to claim 6, wherein the aging control unit performs aging operation, when the voltage control unit cannot control the direct current value corresponding to at least one of the charging members within the target current range, or when ambient temperature of the image forming apparatus is lower than a predetermined temperature.

10. The color image forming apparatus according to claim 6, wherein the aging control unit performs aging operation in powering on the image forming apparatus or in recovering from a power saving mode.

11. The color image forming apparatus according to claim 6, wherein the aging control unit ends aging operation, when direct current values corresponding to all the charging members reach the target current range, or when a previously-set predetermined time elapses.

12. The color image forming apparatus according to claim 11, wherein the predetermined time is set based on ambient temperature of the image forming apparatus.

* * * * *